United States Patent [19]

Borrelli et al.

[11] 4,318,978

[45] Mar. 9, 1982

[54] PHOTOSENSITIVE FILM AND METHODS

[75] Inventors: Nicholas F. Borrelli, Elmira; Peter L. Young, Horseheads, both of N.Y.

[73] Assignee: Corning Glass Works, Corning, N.Y.

[21] Appl. No.: 141,061

[22] Filed: Apr. 17, 1980

Related U.S. Application Data

[62] Division of Ser. No. 739,121, Nov. 5, 1976.

[51] Int. Cl.[3] ..... G03C 7/00; G03C 5/22

[52] U.S. Cl. ..... 430/346; 430/292; 430/293; 430/290; 430/495; 430/496; 430/417; 430/374

[58] Field of Search ..... 204/157.1 R; 430/495, 430/496, 297, 417, 367, 290, 374

[56] References Cited

U.S. PATENT DOCUMENTS 3,637,381 1/1972 Hallman et al. ..... 430/297

3,658,540 4/1972 Malinowski ..... 430/495

OTHER PUBLICATIONS

*J.O.S.A.*, vol. 24, 1934, pp. 316–330.

*Journal of Applied Physics*, vol. 37, #7, 1966, pp. 2775–2781.

*Journal of Chemical Physics*, vol. 4, #1, 1965, pp. 414–417.

Journal of the Optical Society of America, vol. 61, #1, 1971, pp. 62–69.

*Primary Examiner*—4

*Assistant Examiner*—John L. Goodrow

*Attorney, Agent, or Firm*—Kees van der Sterre

[57] ABSTRACT

Methods for making photosensitive thin film structures comprising one or more metal-dielectric layers, produced by the sequential deposition of discontinuous metal island films and transparent covering films containing selected dielectric acceptor materials, and the use of the photosensitive thin film structures to record full-color and/or dichroic images, are described.

2 Claims, 5 Drawing Figures

BLEACHED FILM TRANSMITTANCE
(polarized light)
□ polarized 0.65 μm bleaching light
● polarized 0.55 μm bleaching light
○ polarized 0.46 μm bleaching light
parallel transmittances
perpendicular transmittances
TRANSMITTANCE (%)
35
30
20
10
5
.450
.500
.550
.600
.650
WAVELENGTH (μm)

PHOTOSENSITIVE FILM AND METHODS

This is a division, of application Ser. No. 739,121, filed Nov. 5, 1976.

BACKGROUND OF THE INVENTION

Photosensitive films comprising silver halides have been a primary object of photographic research. Although the photolytic reduction of halides to provide the latent silver photographic image is of major interest, the reverse reaction through which metallic silver is reconverted to a silver halide by the action of light or heat has also been the subject of study.

An early discussion of the changes in absorption behavior produced in a darkened photographic plate by exposure to red light is provided by Cameron and Taylor in *Photophysical Changes in Silver-Silver Chloride Systems,* Journal of the Optical Society of America, Volume 24, pages 316–330 (1934). These authors verified that optically or chemically darkened silver halide-containing emulsions can be selectively bleached, particularly with red light, such that they become more transparent to light of the bleaching wavelength. This behavior is referred to as color adaptation. It was further noted that polarized bleaching light produced a dichroic, birefringent image in the darkened film.

Optically-induced dichroism has also been observed in polycrystalline silver halide layers produced by evaporation techniques. Enhanced dichroism in silver halide films containing additions of vacuum-evaporated silver was reported by V. P. Cherkashin in *Soviet Physics—Solid State,* Volume 13, Number 1, pages 264–265 (1971).

It has been postulated that the anisotropic absorption behavior of silver halide films is due to enlongated metallic silver colloids. This hypothesis is not inconsistent with certain absorption characteristics which have been observed for granular metal films. The optical properties of some sputtered gold and silver island films are described by R. H. Doremus in *J. Chem. Phys.,* Volume 42, pages 414–417 (1964), by R. W. Cohen et al., in *Physical Review B,* Volume 8, Number 8, pages 3689–3701 (1973), and in other papers.

SUMMARY OF THE INVENTION

We have now discovered configurations for photosensitive thin films, and methods for producing them, by means of which full color images may be photographically recorded in a single exposure utilizing ordinary white light. These films also permit the recording of optically anisotropic images, provided that polarized light is used to project the image to be recorded onto the film. Images thus produced are both dichroic (light polarizing) and birefringent.

Photosensitive thin films provided in accordance with the invention are of the additively-colored type, which means that, as initially formed, they contain metallic color centers and thus rather broadly absorb visible light. The films include not only a polycrystalline dielectric film, but also an underlying metallic sub-film, preferably deposited by a sputtering or vacuum evaporation technique, which is responsible for the additive coloration observed.

These films are photosensitive as formed, and record optical information by means of a bleaching process wherein the array of metallic color centers is modified by exposure to light of a selected wavelength. The modification is such that the film becomes substantially more transparent to light of the wavelength used for exposure, but not significantly more transparent with respect to light of other wavelengths. Moreover, if polarized bleaching light is used, the increased transmittance induced by bleaching is limited largely to light polarized in the same direction as the bleaching light. In both cases, the degree of bleaching depends on the intensity of and duration of exposure to the bleaching light.

Photosensitive films provided in accordance with the invention accurately record the intensity and direction of polarization of light incident thereon, and, in addition, are capable of retaining most of the color information present in the incident light. Although somewhat less sensitive to blue and green light than to red light, the films are nevertheless quite satisfactory for recording full-color optical images. The reason for the rather broad color sensitivity of these films is not fully understood, but is believed to depend on the microstructure of the films, which in turn depends on the process by which the films are made. A further advantage of these films is the extremely high image resolution obtainable therewith, which is on the order of 1–10 microns. This value compares favorably with similar values for high resolution photographic film.

Photosensitive thin films provided in accordance with the invention include at least one two-component structural layer, hereinafter referred to as a metal-dielectric layer, which consists of a metal sub-film and a transparent dielectric over-film covering the metal sub-film. The complete photosensitive film may consist of one or several of such metal-dielectric layers, depending upon the degree of resolution or color-reproducing characteristics required in the completed thin film structure.

The process of providing the film comprises the initial step of depositing on a suitable support a discontinuous metal island film. The metal selected for depositing the film must be one which, in island form, exhibits plasma absorption of light when surrounded by a suitable dielectric acceptor material. Such behavior renders the peak wavelength of absorption and the peak half width dependent upon the size and shape of the metal islands, as well as on the refractive index of the dielectric. Among the metals suitable for making up the metal island film are Ag, Pb, Cu, Al, Cr, and Ge.

The absorption properties of the metallic phase of the photosensitive thin film depend on the size and shape of the metal particles therein. Although considerably affected by subsequent processing, the size and shape of the particles depend in the first instance on the structure of the metal island film first deposited. For best imaging properties, we have found that an island film having an apparent thickness in the range of about 15–150Å, which is largely composed of metal islands in a size range of about 100–1000Å, should be provided.

Following the deposition of a discontinuous metal island film as above described, a transparent covering film consisting at least predominantly of a suitable dielectric acceptor material is deposited over the island film. This dielectric acceptor film must fulfill at least two functions. First, it must be capable of accepting and conducting away from a metallic color center photoemitted electrons ejected from the metal by the action of light. Secondly, it must permit diffusion of the positive metal ions produced by photoemission away from the metallic color centers and into the dielectric film.

Among the dielectric acceptor materials which have been found suitable for this purpose are AgCl, AgBr, AgI and $PbI_2$.

The dielectric acceptor material is intended to form a transparent covering film over the discontinuous metal island film. In addition, its thickness has some effect on the color imaging properties of the photosensitive thin film structure. In general, continuous films of at least about 300Å thickness are preferred for best results. The maximum thickness of the film is limited only by the need for transparency, although resolution tends to be poorer with thicker films. Films as thick as one micron have been employed, and thicker films may also be used, although no significant advantages are offered thereby.

Through the use of the above procedures, a photosensitive medium useful for recording optical information may readily be provided. This medium includes support means in the form of a substrate and a photosensitive thin film deposited on the substrate. The film includes at least one metal-dielectric layer consisting of a metal sub-film and a transparent dielectric over-film covering the metal sub-film, produced as above described.

In general, photosensitive thin films including only a single metal-dielectric layer impart the highest image resolving power to the recording medium. However, enhanced color imaging is provided in some cases if several metal-dielectric layers, e.g. 2–6 layers, are provided on a single substrate. Photosensitive thin films including two or more metal dielectric layers may be conveniently produced by sequentially repeating the steps of island-film deposition and dielectric film deposition as above described.

The photographic recording of a full-color optical image in accordance with the invention comprises the step of projecting a selected real full-color image onto a photosensitive thin film which includes at least one metal-dielectric layer produced as above described. The selected real image may be projected onto the photosensitive thin film by any suitable method, including lenses, imaging mirrors or similar focusing means. Prerecorded images such as color transparencies or the like may be projected onto the film or transferred thereto by "contact-printing", i.e., direct exposure of the film through a transparency in contact therewith.

The period of exposure required for recording a selected image in the photosensitive film depends primarily upon the intensity of the recording light and secondarily upon the particular composition of the film selected for treatment. However, the proper exposure interval can be readily determined for any particular film and exposure condition by observing the development of the positive image during the exposure period and terminating exposure when the optimum image is obtained.

The capability of photosensitive thin films provided in accordance with the invention to record information relating to the polarization state of light traversing the film permits the recording of dichroic images therein. Dichroic recorded images are produced by projecting onto the film a selected real image, which may be a full-color image, utilizing light which is linearly polarized along a selected axis. This axis is hereinafter referred to as the recording axis. Images formed using linearly polarized light are dichroic in that they exhibit good transmittance and are readily viewable in transmitted light polarized in a direction parallel to the recording axis, but decreased transmittance and low contrast and coloration when viewed in light polarized perpendicularly to the recording axis.

Dichroic images produced by recording in polarized light offer two distinct advantages over conventionally-recorded images. First, the color quality of the recorded dichroic image is enhanced, by comparison with a conventionally-recorded image, when viewed in white light linearly polarized in the direction of the recording axis. Secondly, the contrast of the dichroic image can readily be enhanced by viewing the recorded image in transmitted light while the film is positioned between crossed polarizers, each polarizer being aligned with its optic axis (axis of maximum light transmittance) at an angle of 45 degrees with the recording axis of the dichroic image. Both advantages involve some sacrifice in the intensity of the transmitted viewing light, but this may not be important for some applications.

Conventional and dichroic images produced as described may be modified by further exposure to bleaching light as necessary. Of course, when it is desired to preserve the recorded image for long time periods, care should be taken to prevent exposure of the recording to stray light. In the absence of such light, however, the recording is quite stable and may be preserved indefinitely.

Films provided in accordance with the invention have utility not only for recording full color photographic images, but also for other information storage applications where information relating to the color and polarization state of incident light is desired to be retained.

DESCRIPTION OF THE DRAWINGS

The invention may be further understood by reference to the appended drawings, wherein.

DETAILED DESCRIPTION

Figure 1:
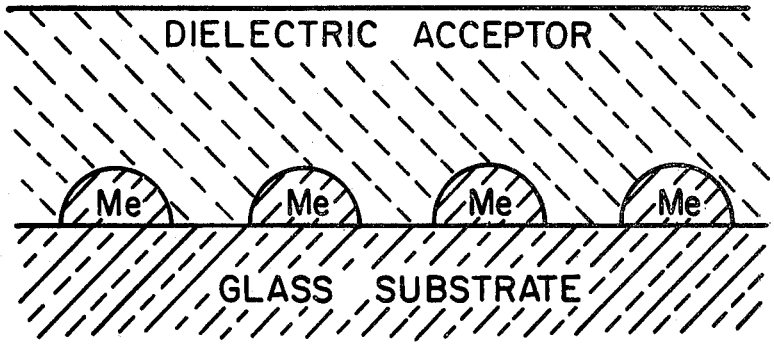
FIG. 1 is a schematic elevational view in cross-section of a photosensitive optical recording medium, including a glass substrate and a photosensitive film, provided in accordance with the invention, wherein the photosensitive film consists of a single metal-dielectric layer which includes a discontinuous metal sub-film comprising metal islands (Me) covered by a transparent over-film composed of a dielectric acceptor material.
Figure 2:
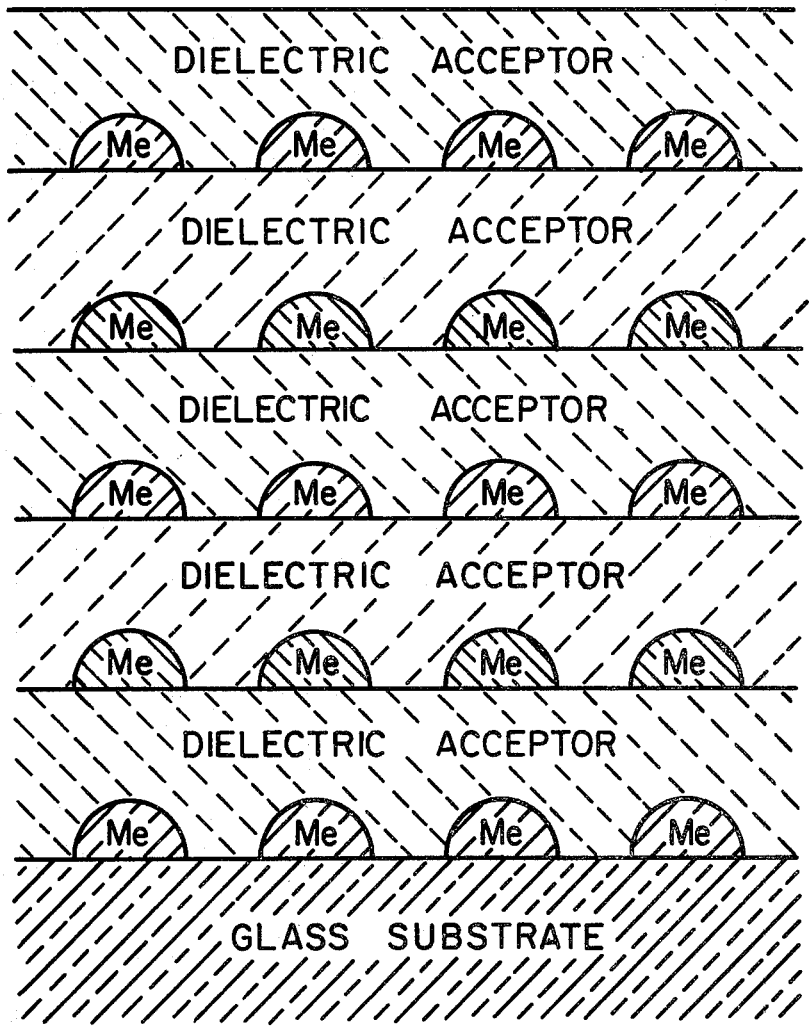
FIG. 2 is a schematic elevational view in cross-section of another embodiment of a photosensitive optical recording medium provided in accordance with the invention, wherein the photosensitive film consists of five metal-dielectric layers.
Figure 3:
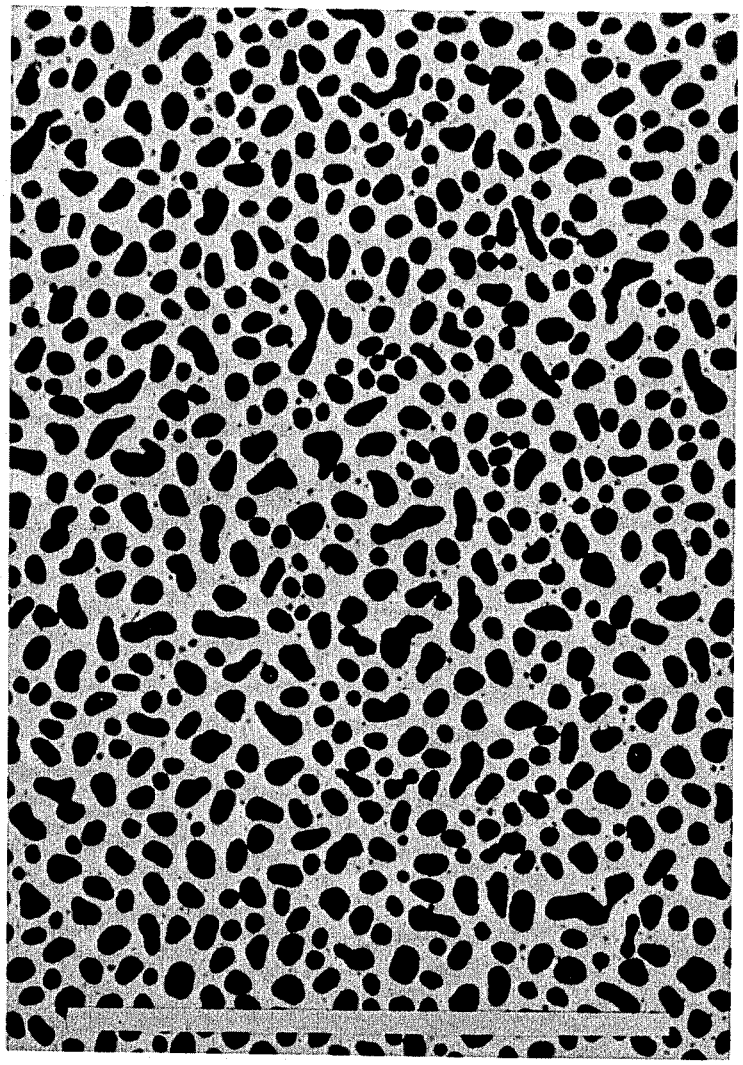
FIG. 3 is an electron photomicrograph of a discontinuous metal island film composed of silver deposited on a support consisting of glass, wherein the white bar represents a length of 0.5 microns.

While the precise mechanism for broad-spectrum photosensitivity in films provided in accordance with the invention has not been definitely established, it is believed that the discontinuous metal-dielectric film structure is sensitive to light in the following way. When light is incident on the structure, the light excites electrons of the metal. This can either be due to interband transition or due to transfer of energy of plasma modes to single electron states. These plasma modes correspond to collective excitations of many electrons and are characteristic of free or nearly free electrons. If the excited electron level exceeds the energy corresponding to the difference in energy of the bottom of the conduction band of the dielectric and the Fermi energy of the metal, then the electron can escape the metal into the conduction state of the dielectric. This process corresponds to photoemission where the effective work function of the metal (energy required to remove electron from metal) is lowered due to the proximity of a dielectric having a suitable conduction band energy.

Another aspect of the proposed mechanism deals with the nature of the dielectric film. In addition to providing a way to allow the electron to escape via a conduction band, it also must have the ability to incorporate the metal ions into the lattice. The diffusion of the metal ions should be relatively rapid to allow the metal dissolution process to proceed rapidly. It has been found that heating the structure can improve the sensitivity to light in certain cases where the metal ion has a slow diffusion coefficient at room temperature.

By the combined process of electron emission from the metal and diffusion of a positive metal ion into the dielectric lattice, the metal island loses an atom. The continuation of the process of photoemitted electron and diffusion of the positive metal ion ultimately dissolves the metal island. One can write then, where $(M_n)$ represents a n-atom metal island, $$(M)_n \xrightarrow{\text{light}} (M)_{n-1}M^+ + e^-$$

$$(M)_{n-1}M^+ \longrightarrow (M)_{n-1} + M^+$$

In terms of the transmission of light through the film, as the light exposure continues, the metal island dissolves, thus decreasing the absorption, making the film more transmitting in the region of exposure.

The color aspect of the process described above comes from the fact that if the excited electron state arises through the damping of the plasma oscillation, then the peak absorption of the plasma oscillation is dictated critically by the size and shape of the metal island colloid as well as the optical constants of the metal and the refractive index of the dielectric medium surrounding the metal island. If the discontinuous metal island film is put down in such a way as to produce a distribution of sizes and shapes of metal islands, then exposure of the thin film structure to a particular visible wavelength of light will preferentially remove those metal island colloids whose size and shape produce a peak absorption corresponding to the illumination light wavelength. This renders that portion of the structure more transmitting to that wavelength than to the other visible wavelengths. It is in this way that full colored images are produced.

The explanation of the dichroic effect follows closely from the postulated coloration mechanism. If the metal island colloid is not spherical in shape, then its optical absorption is also anisotropic. For example, if the shape of the metal particle is represented by a prolate ellipsoid of revolution, then the absorption in the long direction (major axis) would be greater for light polarized along that direction then that perpendicular to the long direction. We presume that the original orientation of nonspherical metal particles is random in space. However upon exposure to polarized light, those metal island colloids whose orientation in space is such that they are more nearly parallel to the polarization direction of the exposing light will be dissolved at a more rapid rate than those whose orientation space is more nearly perpendicular to the polarization direction of the incident light. Thus the exposure to polarized light renders the thin film structure dichoric.

Of course, the foregoing explanation is hypothetical only, and is not intended to limit the scope of the invention as herein described.

The selection of a substrate to be utilized as support means for photosensitive films to be provided in accordance with the invention is not critical. Any substrate material which does not harmfully interact with the dielectric and metallic film constituents to be applied thereto may be employed. Examples are inert ceramic materials, glass-ceramics, and even treated paper. Although reflective substrates can be used, light-transmitting substrates, preferably transparent, will normally be preferred in order to facilitate the retrival of stored information from the film. The particularly preferred substrate for use in the invention is glass.

In some cases, it may be desirable to deposit a base layer on the substrate to insure compatibility with the photosensitive film. Thus an organic substrate such as paper may be provided with a base layer of SiO, or a glass substrate may be provided with a base layer, for example, of a dielectric acceptor material.

The deposition of a suitable discontinuous metal island film onto the substrate is preferably accomplished utilizing either sputtering or vacuum evaporation techniques. However, other metal deposition methods, including certain plating processes, may also be employed. While the apparatus utilized for the deposition process may be conventional, the deposition conditions employed have an important effect on the imaging properties of the resultant film.

D-C or radio-frequency sputtering may be used to deposit any of Ag, Pb, Cu, Cr, Ge and Al. Control over the thickness and island size of the discontinuous metal film is achieved by varying the sputtering voltage, the temperature of the substrate and the biasing voltage between the substrate and target. The condition of the target which is the source of metal for the film is also important; for example, a silver target which has been partially oxidized in use appears to provide better results in certain cases than a clean, unoxidized silver target.

Vacuum evaporation processes can also be used to produce the island film, and are particularly useful for depositing Ag, Ge, Pb, and Cu. Control over island film thickness and island size distribution are exercised by varying substrate temperature, deposition rate, the temperature of the evaporated material, and the base pressure of the vacuum system.

Table I below sets forth vacuum evaporation conditions for some metals which are illustrative of the conditions which may be employed to produce island films therefrom exhibiting good imaging properties. The table reports the base pressure in the system, the substrate temperature, and the deposition rate provided.

These conditions are of course merely illustrative of the various deposition conditions which could be employed.

TABLE I

| Evaporated Metal | System Base Pressure | Substrate Temperature | Film Deposition Rate |
|---|---|---|---|
| Ag | $5 \times 10^{-6}$ Torr | 150° C. | 1Å/second |
| Pb | $5 \times 10^{-6}$ Torr | 25° C. | 1Å/second |
| Cu | $5 \times 10^{-6}$ Torr | 25° C. | 1Å/second |
| Ge | $5 \times 10^{-6}$ Torr | 25° C. | 1Å/second |

Conditions similar to those described in Table I above are useful not only to deposit the initial island film, but also to deposit subsequent films when multi-layer photosensitive films are to be provided.

Following the deposition of the selected metal island film, the dielectric acceptor material may be vacuum evaporated directly onto the metal island film to provide the transparent covering film. The imaging properties of the resulting metal-dielectric layer are affected by the rate of evaporation of the dielectric, the thickness of the dielectric film, and the composition of the film.

The dielectric covering film should consist at least predominantly of one or more dielectric acceptor materials selected from the group consisting of AgCl, AgBr, AgI and $PbI_2$. For the purpose of the present description, the covering film consists predominantly of these acceptor materials if the materials constitute at least about 50% of the film. Although the film may consist entirely of these materials, we have found that the color imaging properties of the metal dielectric layer can be improved in some cases if minor amounts, e.g., up to about 30% by weight, of a dopant selected from the group consisting of CuCl, $CuCl_2$ and $CdCl_2$ is included in the film. The decision to include these optional dopants will depend on the intended use of the film. The film may of course include other constituents which do not interfere with the imaging properties of the system.

Table II below sets forth vacuum evaporation conditions which are typical of conditions useful in depositing a transparent dielectric covering film over a metal island film to provide good imaging properties in the resulting metal-dielectric layer. The table reports the system pressure, the rate of deposition of the dielectric, and the temperature of the substrate for a number of different dielectric acceptor materials. Again these conditions are merely illustrative of the range of conditions which may be employed.

TABLE II

| Dielectric Acceptor Material | System Base Pressure | Dielectric Evaporation Rate | Substrate Temperature |
|---|---|---|---|
| AgCl | $1 \times 10^{-4}$ Torr | 50Å/second | 25° C. |
| AgBr | $1 \times 10^{-4}$ Torr | 50Å/second | 25° C. |
| AgI | $1 \times 10^{-4}$ Torr | 50Å/second | 25° C. |
| $PbI_2$ | $1 \times 10^{-4}$ Torr | 50Å/second | 25° C. |

Of course, alternative methods of applying both the discontinuous metal island films and the covering dielectric films may be employed, provided that the requisite film thicknesses and island size and size distribution for good imaging are provided.

The invention may be further understood by reference to the following detailed examples illustrating some of the preferred procedures for producing and utilizing photosensitive films in accordance therewith.

EXAMPLE 1

A clean glass slide having a smooth surface suitable for film deposition is positioned in a vacuum evaporation coating chamber together with a quantity of AgCl. The chamber is evacuated to a pressure of $5 \times 10^{-6}$ Torr and, while the slide is maintained at about 25° C., the AgCl is heated to cause evaporation and subsequent deposition onto the slide at a rate of about 10Å/second. The deposition process is continued until an AgCl film about 400Å in thickness has been provided on the glass substrate.

Following the deposition of an AgCl base layer as described, a discontinuous metal island film composed of Pb is vacuum-deposited over the AgCl film by heating a quantity of Pb introduced into the chamber. The chamber pressure is maintained at about $5 \times 10^{-6}$ Torr during evaporation. The deposition of Pb occurs at a rate of about 1Å/second and is continued until a thickness equivalent to about 30Å is provided. Thereafter, a transparent covering layer of AgCl, about 400Å in thickness, is vacuum-deposited over the Pb layer utilizing the procedure previously employed for the deposition of the AgCl base layer.

The process of Pb deposition followed by AgCl deposition is repeated three times to provide a photosensitive thin film structure consisting of a base AgCl layer and four superimposed Pb metal-AgCl dielectric layers on the glass slide. The slide is then removed from the vacuum chamber and examined. A transparent film exhibiting a light purple coloration in transmitted light is observed on the glass surface.

The optical properties of the thin film structure thus provided may be demonstrated by irradiating selected regions of the film with visible bleaching light of several different wavelengths for time intervals on the order of about a minute at light intensities on the order of about 10–20 milliwatts/$cm^2$. The results of such bleaching are shown in FIGS. 4 and 5 of the drawing.

Figure 4:
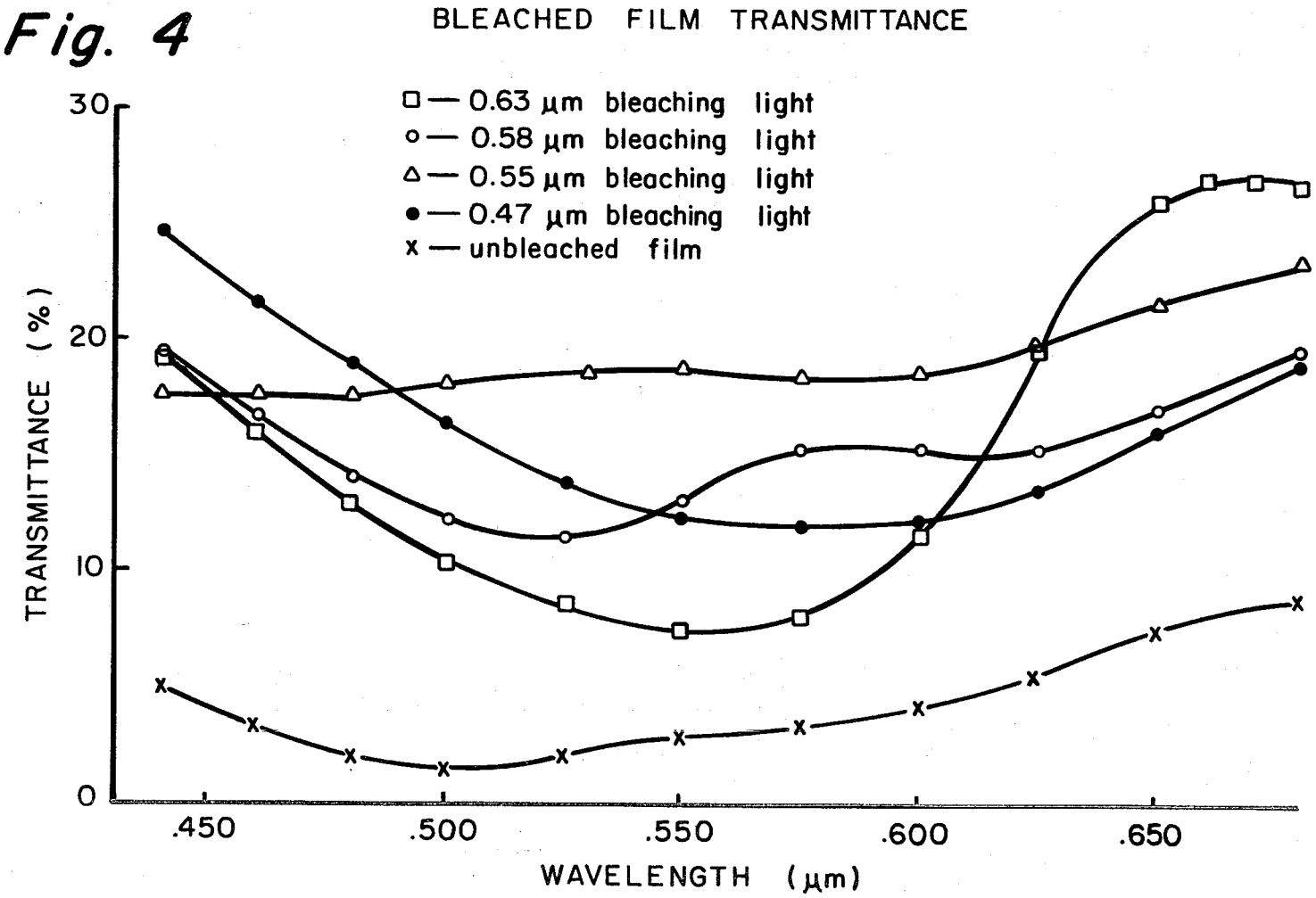
FIG. 4 is a graph plotting the light transmittance through four selected optically-bleached regions of a multi-layer Pb metal-AgCl dielectric photosensitive film as a function of light wavelength. Each of the four selected regions of the film had been previously bleached with a different wavelength of visible light, each wavelength producing a different coloring effect in the photosensitive film. The unbleached transmittance of the film is also shown.

FIG. 4 illustrates the effect on the transmittance of the film induced by bleaching with four different wavelengths of unpolarized light. Each of the different sources produces bleaching in and near its own wavelength, producing a different coloring effect in the film.

Figure 5:
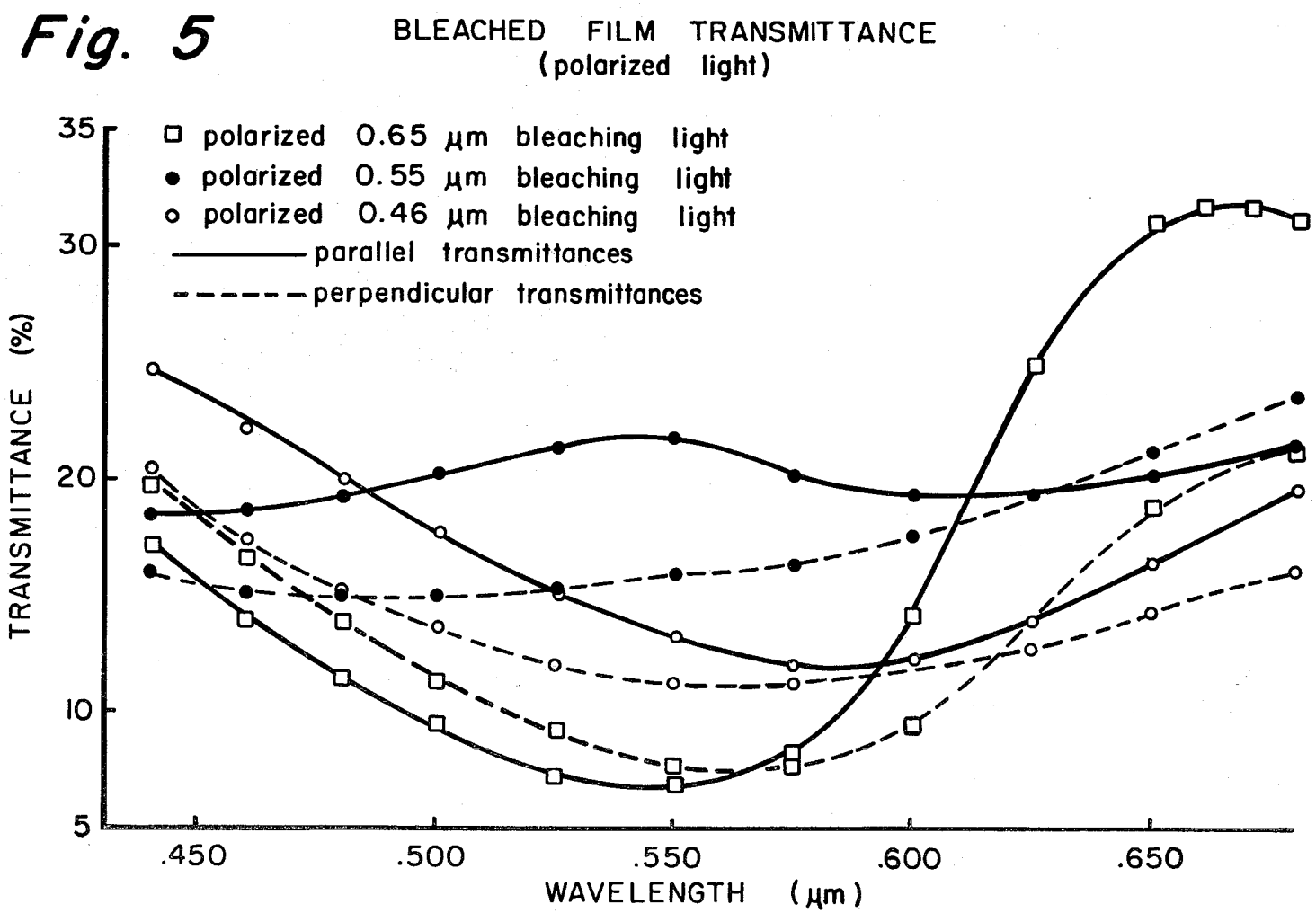
FIG. 5 is a graph plotting the transmittance of polarized light through three selected optically-bleached regions of a multi-layer Pb metal-AgCl dielectric film as a function of wavelength. Transmittance is shown for each of two orthogonally-polarized light beams. Each of the three selected regions of the film had been previously bleached with polarized light having a direction of polarization corresponding to the light beam producing the parallel transmittance curves shown in the drawing. The dichroism induced by bleaching with polarized rather than unpolarized light is evidenced by the fact that, at each of the three bleaching wavelengths, the transmittance of the glass is higher with respect to light polarized parallel to the direction of polarization of the bleaching light (solid curve) than with respect to light polarized perpendicular thereto (broken curve).

FIG. 5 illustrates the dichroism induced by bleaching with polarized light at three different wavelengths. The bleached regions exhibit not only coloration but also substantially greater transmittance, near the bleaching wavelength, of light polarized parallel to the direction of polarization of the bleaching light than light polarized perpendicularly thereto.

EXAMPLE 2

A clean glass slide having a smooth surface suitable for film deposition is positioned in the substrate holder of a triode-type radio-frequency sputtering apparatus comprising a silver target. With the substrate holder maintained at about 25° C., the deposition chamber is evacuated to a pressure of $10^{-6}$ Torr. The chamber is then back-filled with argon to a pressure of $5\times10^{-3}$ Torr, and an r-f voltage of 400 V. is applied to the target. Simultaneously, a d.c. bias voltage of 45 V. is applied between the target and the substrate. These conditions produce a sputtering rate providing Ag deposition at about 9Å/minute onto the surface of the glass slide. Sputtering is continued for a time interval sufficient to provide an Ag film 100Å in thickness on the glass surface.

Following the deposition of the silver film, the glass slide is removed from the sputtering apparatus and positioned in a vacuum evaporation coating chamber together with a quantity of AgCl. The chamber is then evacuated to a pressure of $1\times10^{-6}$ Torr and, while the slide is maintained at a temperature of about −70 C., the AgCl is heated to cause evaporation and subsequent deposition onto the silvered glass at a rate of about 50Å/second. This deposition process is continued until an AgCl film about 1500Å in thickness is provided.

The image-forming properties of the film thus provided are tested by projecting a real image of a photographic transparency illuminated by a 100-watt tungsten iodide lamp onto the surface of the film with a photographic lens. An exposure time on the order of about 15 seconds under these conditions produces an image exhibiting excellent color reproduction, contrast and image resolution in the photosensitive film.

EXAMPLE 3

A clean glass slide having a smooth surface suitable for film deposition is positioned in a vacuum evaporation chamber together with a quantity of silver. The chamber is evacuated to a pressure of $5\times10^{-6}$ Torr and, while the glass slide is maintained at a temperature of about 50° C., the silver is heated to cause vaporization and subsequent deposition on the surface of the glass slide at a rate of about 1Å/second. The deposition process is continued until a silver film about 50Å in thickness is provided.

Following the deposition of the silver film a mixture consisting mainly of AgCl but with a minor proportion of $CdCl_2$ is introduced into the chamber and heated to cause deposition of an AgCl film comprising about 10% $CdCl_2$ by weight onto the silvered glass surface, this deposition occurring at a rate of about 100Å/second. The deposition process is continued for a time sufficient to provide a transparent covering film about 1500Å in thickness over the silver film. The coated slide is then removed from the chamber.

The Ag metal-AgCl dielectric film produced by the described process exhibits imaging properties which include very good color reproduction, contrast and image resolution.

In all cases of film fabrication in accordance with the invention as above described, there is evidence that substantial interaction between the selected metal and the selected dielectric occurs during the deposition of one film type onto the other. For this reason it is doubtful that the original island structure of the metallic film is preserved unchanged through the deposition process. Unfortunately, resolution of the final structure of the photosensitive film is presently impossible due to the volatile nature of the component species, which interferes with electron microscopic examination. Nevertheless, it presently appears that the use of deposition conditions leading to the formation of an island film of the specified structure is an essential step in the production of photosensitive films exhibiting reasonably broadband color sensitivity in accordance with the invention herein described.

We claim:

1. A method for photographically recording full-color optical images which comprises the step of projecting with bleaching light at exposure levels a selected real full-color image onto a photosensitive thin film which includes at least one metal-dielectric layer consisting of a metal sub-film and a transparent dielectric over-film covering said metal sub-film, said metal-dielectric layer being produced by:

(a) depositing a discontinuous metal island film composed of a metal selected from the group consisting of Ag, Pb, Cu, Al, Cr and Ge on a support, said film having an apparent thickness in the range of about 15–150Å, and including metal islands ranging in size from about 100–1000Å; and (b) depositing over said discontinuous metal island film a transparent covering film consisting at least predominantly of a dielectric acceptor material selected from the group consisting of AgCl, AgBr, AgI, and $PbI_2$.

2. A method for photographically recording full-color optical images to provide dichroic recorded images exhibiting enhanced color quality and contrast when viewed in transmitted, linearly-polarized light which comprises the step of projecting with polarized bleaching light at exposure levels a selected real, full-color optical image, formed by light linearly polarized along a selected recording axis, onto a photosensitive thin film which includes at least one metal-dielectric layer consisting of a metal sub-film and a transparent dielectric over-film covering said metal sub-film, said metal-dielectric layer being produced by:

(a) depositing a discontinuous metal island film composed of a metal selected from the group consisting of Ag, Pb, Cu, Al, Cr and Ge on a support, said film having an apparent thickness in the range of about 15–150Å, and including metal islands ranging in size from about 100–1000Å; and (b) depositing over said discontinuous metal island film a transparent covering film consisting at least predominantly of a dielectric acceptor material selected from the group consisting of AgCl, AgBr, AgI and $PbI_2$;

said recorded image exhibiting enhanced color quality when viewed in transmitted light linearly polarized in a direction parallel to said recording axis and enhanced contrast when viewed in transmitted light between crossed polarizers aligned with their optic axes at an angle of 45 degrees with said recording axis.

* * * * *